United States Patent [19]

Eskeli

[11] 4,030,856

[45] June 21, 1977

[54] ROTOR WITH JET NOZZLES

[76] Inventor: Michael Eskeli, 7994-41 Locke Lee, Houston, Tex. 77042

[22] Filed: Feb. 20, 1976

[21] Appl. No.: 659,797

Related U.S. Application Data

[63] Continuation-in-part of Ser. No. 568,895, April 17, 1975, Pat. No. 4,003,673.

[52] U.S. Cl. ..... 415/80; 415/1

[51] Int. Cl.[2] ..... F01D 1/18

[58] Field of Search ..... 415/80, 109, 1; 60/39.35

[56] References Cited

UNITED STATES PATENTS

| | | | |
|---|---|---|---|
| 709,242 | 9/1902 | Prescott | 415/80 |
| 715,152 | 12/1902 | Roeske | 415/80 |
| 1,250,663 | 12/1917 | Rohmer | 415/80 |
| 2,456,417 | 12/1948 | Horsdal | 415/80 |
| 2,467,990 | 4/1949 | Powledge | 415/80 |
| 2,596,276 | 5/1952 | Napoli | 415/80 |
| 3,304,051 | 2/1967 | Calhoun | 415/80 |
| 3,879,152 | 4/1975 | Eskeli | 415/80 |
| 3,945,757 | 3/1976 | Cummens | 415/80 |

FOREIGN PATENTS OR APPLICATIONS

| | | | |
|---|---|---|---|
| 181,146 | 8/1903 | Germany | 415/80 |
| 603,487 | 4/1960 | Italy | 415/80 |
| 158,919 | 2/1933 | Switzerland | 415/80 |
| 371,482 | 4/1932 | United Kingdom | 415/80 |

*Primary Examiner*—C. J. Husar

[57] ABSTRACT

A method and apparatus for the generation of high velocity fluid jets by using a rotor with attached discharge passages and nozzles. A working fluid is accelerated by using a rotating rotor, either of the free vortex type or of the forced vortex type, and the accelerated fluid is then passed through forwardly and inwardly extending passages, and discharged at high speed through openings that are inward from the rotor periphery. Fluids may be either liquids or gases. The high velocity fluid jet may be used where such jets are required, such as excavation, cutting, or as a source of thrust. The rotors may be also made multistage, if additional jet velocity is required.

5 Claims, 6 Drawing Figures

ROTOR WITH JET NOZZLES

CROSS REFERENCES TO RELATED APPLICATIONS

This application is a continuation-in-part application of "Fluid Pressurizer", Ser. No. 568,895, filed 4/17/75, now U.S. Pat. No. 4,003,673.

BACKGROUND OF THE INVENTION

This invention relates generally to apparatus for providing a high velocity fluid jet.

Previously, high velocity fluid jets have been provided by using a pump to force a fluid at high pressure through a nozzle, thus providing for fluid acceleration. Such apparatus is costly due to the heavy equipment required, and uses large amounts of power.

SUMMARY OF THE INVENTION

The object of this invention is to provide a relatively simple means for generating a high velocity fluid jet, in a single rotating rotor, using the rotor to accelerate a working fluid, and then passing the working fluid via passages that allow the fluid to travel in the tangential direction faster than the local rotor speed, with the fluid passages leading the fluid inward toward the rotor center. The fluid is then discharged from the rotor through openings or nozzles at a high velocity, usually at an absolute direction that is nearly parallel to the rotor shaft.

DESCRIPTION OF PREFERRED EMBODIMENTS

Figure 1:
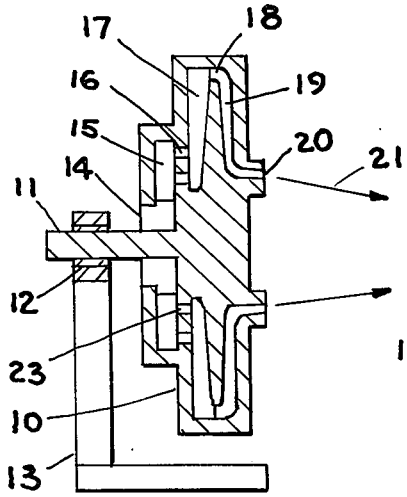
FIG. 1 is a cross section of one form of the apparatus.

In FIG. 1, the rotor 10 is supported by shaft 11, bearings 12 and base 13. Working fluid enters the rotor via opening 14 and is first pressurized in passages defined by vanes 15, and then passed through forwardly oriented nozzle rows 16 and 23 into free vortex cavity 17, with pressurization there, the fluid passes via openings 18 into passages 19, and from there via exit openings 20 leaves the rotor. 21 indicates that the jets leaving openings 20 may be arranged to converge at a point some distance away.

Figure 2:
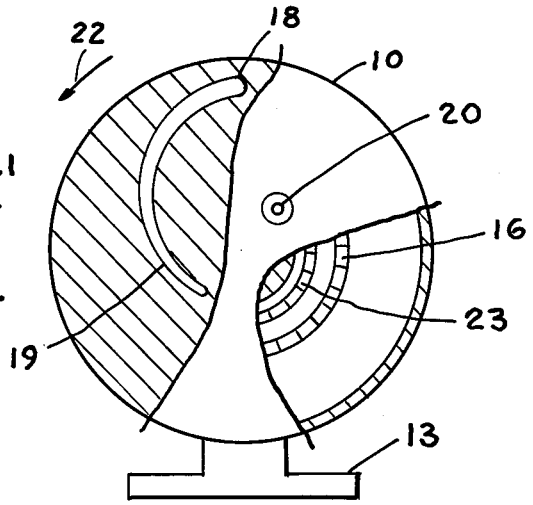
FIG. 2 is an end view of the unit of FIG. 1.

In FIG. 2, 10 is rotor, 20 is exit, 16 and 23 are feeder nozzle rows, 13 is base, 19 is working fluid passage, and 22 indicates direction of rotation of rotor.

Figure 3:
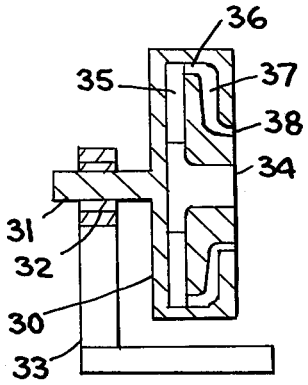
FIG. 3 is a cross section of another form of the apparatus.

In FIG. 3, a cross section of another form of the apparatus is shown. Rotor 30 is supported by shaft 31, bearing 32 and base 33. Fluid enters via opening 34, passes via radial passages defined by vanes 35, and passes via openings 36 into passages 37, and from there to exit openings 38.

Figure 4:
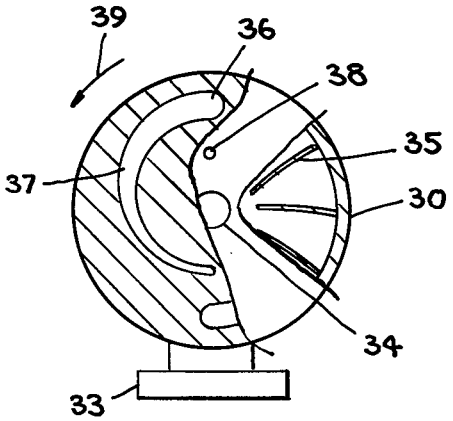
FIG. 4 is an end view of the unit of FIG. 3.

In FIG. 4, an end view of unit of FIG. 3 is illustrated. 30 is rotor, 34 is fluid entry, 33 is base, 37 is fluid passage, 39 indicates direction of rotation for rotor, 36 is fluid passage, 38 is fluid exit, and 35 is vane in outward extending passage.

Figure 5:
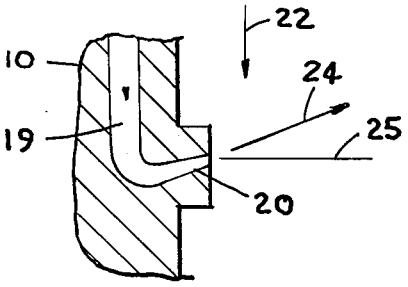
FIG. 5 is a discharge nozzle detail.

In FIG. 5, a detail of the rotor exit nozzles or openings is shown. The section of this detail is 90° transverse to the section of FIG. 1. 10 is rotor, 22 indicates rotor rotation, 19 is fluid passage, 20 is exit opening or nozzle, 24 indicates direction of fluid leaving the opening, with the leaving direction usually being backward with respect to the rotor rotation direction, and 25 indicates orientation of rotor shaft.

Figure 6:
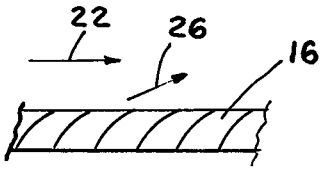
FIG. 6 is a detail of one form of the feeder nozzles used in the unit of FIG. 1.

In FIG. 6, a detail of the feeder nozzles as used in the unit of FIG. 1, is illustrated. 22 indicates the direction of nozzle movement, 16 are the nozzles, and 26 indicates the direction of leaving fluid, with the direction of the leaving fluid being forwardly.

In operation, in the unit shown in FIG. 1, the working fluid is pressurized in the forced vortex cavity formed by vanes 15, and then discharged via the feeder nozzles into the free vortex cavity 17 in forwardly direction so that the tangential velocity of the rotor, and the leaving velocity of the fluid are added. In the free vortex cavity 17 the fluid is pressurized further and then the pressurized fluid is passed into discharge passages 19, which are oriented to allow the fluid to travel at a higher tangential velocity than the rotor. After passage through passage 19, the fluid is passed out from the rotor via openings 20. Rotor is rotated by a drive connected to shaft.

The operation of the unit of FIG. 3 is similar, except that the free vortex cavity is omitted, and the rotor has a forced vortex only to pressurize and accelerate the working fluid.

The passages 19 and 37 are shown in the drawings to be curved and tapering. The curving provides for best efficiency, but is not mandatory; straight forward passages, with their exit nearer to rotor center than the entry, can be used also. The tapering of passages 19 and 37 also is for best efficiency, to provide for cross sectional area of the passage to match the fluid velocity.

The exit openings 20 and 38 are usually nozzles to provide for additional acceleration of the fluid, and to utilize any available pressure that may still be remaining in the fluid. These nozzles are usually oriented as shown in FIG. 5, to provide for axial discharge of the working fluid from the rotor. Further, the nozzles may be arranged to converge the fluid streams into s single point as shown in FIG. 1, external to the rotor. Obviously, the nozzles 20 or nozzles 38, may be also brought into a single point at an area near rotor center, to discharge the working fluid through a single opening or nozzle. A single exit opening near rotor center may be desirable in instances where the working fluid pressure in sufficient at rotor periphery, and a single fluid jet is desired. In FIG. 1 and FIG. 2, two passages 19 are shown; one passage 19 may be used, or more than one may be used as desired.

The unit of FIG. 1 may be made multistage, by using the fluid leaving via openings 20 as the feed fluid for the next stage free vortex cavity; in such arrangement, nozzles 20 will replace nozzles 16 and 23. Alternately, the device of FIG. 3, may be used as the first stage, and the second stage may be similar to the unit of FIG. 1. As is obvious, various combinations of the units of FIG. 1 and FIG. 3 may be used.

Also, the unit of FIG. 1 may be made into a regenerative unit by feeding a part of the fluid passing through passage 19 into free vortex cavity 17, with the feeder arranged to discharge the recirculated fluid forwardly to assist in the circulation of the working fluid within the free vortex cavity. Such arrangement is shown in a co-pending patent application. "Rotor with Recirculation", filed Nov. 28, 1975, Ser. No. 636,310.

By using multistage arrangements, combinations of the unit of FIG. 1 and FIG. 3, and recirculation, the rotor speeds can be reduced, thus making the unit lighter in weight, and less costly.

Applications for this apparatus include cutting of materials, use in excavation of rock and soil, in thrust generation and in all uses where a high velocity fluid jet is desired.

Working fluids may be either liquids, or gases.

The rotor of the form of FIG. 1 was the subject of my previous U.S. Pat. No. 3,879,152.

I claim:

1. In a rotating rotor, wherein a working fluid enters said rotor through an entry and is accelerated by said rotor, the improvement comprising:

a. discharging said working fluid through an inwardly extending fluid passage, with said passage being arranged to allow movement of said working fluid forwardly in the direction of rotation for additional acceleration of said working fluid, with said working fluid being discharged from said rotor via an exit opening communicating with the inward end of said fluid passage.

2. The rotor of claim 1 wherein said fluid passage is curved forwardly in the direction of rotation to pass said working fluid spirally inwardly to allow acceleration of said working fluid within said fluid passage before leaving said rotor.

3. The rotor of claim 1 wherein said exit opening is a converging nozzle.

4. A method of generating a high velocity fluid jet comprising the steps of:

a. accelerating a fluid in a rotating rotor to a tangential velocity that is approximately the same as the tangential velocity of said rotor in the area near rotor periphery;

b. further accelerating said fluid within said rotor in an inwardly and forwardly extending fluid passage;

c. discharging said fluid from said rotor via an exit opening that is nearer to the rotor center than the rotor periphery.

5. The method of claim 4 comprising the further step of accelerating said fluid further in exit nozzles that are said exit openings.

* * * * *